US010495107B2

(12) United States Patent
Schmidtke

(10) Patent No.: US 10,495,107 B2
(45) Date of Patent: Dec. 3, 2019

(54) GUIDE VANE ASSEMBLY WITH COMPENSATION DEVICE

(71) Applicant: Rolls-Royce Deutschland Ltd & Co KG, Blankenfelde-Mahlow (DE)

(72) Inventor: Sabrina Schmidtke, Berlin (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 107 days.

(21) Appl. No.: 15/821,191

(22) Filed: Nov. 22, 2017

(65) Prior Publication Data

US 2018/0142705 A1 May 24, 2018

(30) Foreign Application Priority Data

Nov. 23, 2016 (DE) ..... 10 2016 122 639

(51) Int. Cl.
*F04D 29/56* (2006.01)
*F01D 9/04* (2006.01)
(Continued)

(52) U.S. Cl.
CPC ..... *F04D 29/56* (2013.01); *F01D 9/041* (2013.01); *F01D 17/141* (2013.01);
(Continued)

(58) Field of Classification Search
CPC ..... F04D 29/56; F04D 29/563; F01D 9/041; F01D 17/141; F01D 17/162
(Continued)

(56) References Cited

U.S. PATENT DOCUMENTS 3,841,788 A 10/1974 Sljusarev et al.
4,812,106 A 3/1989 Purgavie
(Continued)

FOREIGN PATENT DOCUMENTS

DE 3819232 A1 1/1989
DE 102014219552 A1 3/2016
FR 3024996 A1 2/2016

OTHER PUBLICATIONS

German Search Report dated Jul. 21, 2017 for counterpart German Application No. 10 2016 122 639.4.
(Continued)

*Primary Examiner* — Nathaniel E Wiehe
*Assistant Examiner* — David Whittaker
(74) *Attorney, Agent, or Firm* — Shuttleworth & Ingersoll, PLC; Timothy J. Klima

(57) ABSTRACT

A guide vane assembly with at least one guide vane row and a housing for the at least one guide vane row that extends along a circumferential direction about a central axis, wherein the at least one guide vane row includes multiple guide vanes that are respectively mounted at the housing in an adjustable manner by means of an adjusting appliance of the guide vane assembly. The adjusting appliance includes at least one adjusting element for adjusting the guide vanes that is arranged at a radial distance to an outer side of the housing with respect to the central axis, and a compensation device is provided, by means of which a radial distance of the adjusting element to the outer side of the housing is predetermined, and the different thermal expansions of the adjusting element and of the housing are at least partially compensated.

19 Claims, 8 Drawing Sheets

(51) Int. Cl.
*F01D 17/14* (2006.01)
*F01D 17/16* (2006.01)

(52) U.S. Cl.
CPC ..... *F01D 17/162* (2013.01); *F04D 29/563* (2013.01); *F05D 2220/323* (2013.01); *F05D 2220/36* (2013.01); *F05D 2230/642* (2013.01); *F05D 2240/12* (2013.01); *F05D 2240/80* (2013.01); *F05D 2260/30* (2013.01); *F05D 2260/50* (2013.01); *F05D 2300/174* (2013.01)

(58) Field of Classification Search
USPC ..... 415/148
See application file for complete search history.

(56) References Cited

U.S. PATENT DOCUMENTS

| | | | | |
|---|---|---|---|---|
| 5,700,129 | A * | 12/1997 | Kocian | F01D 17/162 403/30 |
| 7,198,454 | B2 * | 4/2007 | Evans | F01D 17/162 415/12 |
| 9,309,778 | B2 | 4/2016 | Ress, Jr. | |
| 2006/0133925 | A1 | 6/2006 | Bouru | |
| 2016/0090856 | A1 | 3/2016 | Klauke | |

OTHER PUBLICATIONS

European Search Report dated Mar. 27, 2018 for counterpart European Application No. EP17202362.4.

* cited by examiner

GUIDE VANE ASSEMBLY WITH COMPENSATION DEVICE

REFERENCE TO RELATED APPLICATION

This application claims priority to German Patent Application No. 10 2016 122 639.4 filed on Nov. 23, 2016, the entirety of which is incorporated by reference herein.

BACKGROUND

The invention in particular relates to a guide vane assembly.

In engines, for example turbomachines and in particular gas turbine engines, it is generally known to provide adjustable guide vanes for influencing the flow depending on the rotational speed of rotating rotor blades. In particular in gas turbine engines, usually adjustable guide vanes are used in the area of the compressor, wherein the guide vanes are adjusted depending on the compressor's rotational speed. In the technical jargon, the adjustable guide vanes are referred to as variable stator vanes, or VSV, in short.

Here, the adjustable guide vanes usually represent a component of a guide vane row and are arranged inside a housing in which the rotating rotor blades are also arranged. In practice, the individual guide vanes are mounted at the housing so as to be respectively adjustable via a bearing journal. Provided inside the housing is usually a rotatable bearing of a guide vane at a hub, e.g. of a compressor. Each bearing journal is mounted in a rotatable manner at the housing inside an associated bearing opening in the wall of the housing. At that, the bearing journal passes through this bearing opening along an extension direction of the bearing journal, so that an end of the bearing journal is accessible at an outer side of the housing for adjusting the corresponding guide vane by turning the bearing journal. At that, usually respectively one lever, which is affixed at an adjusting element in the form of an adjusting ring of an adjusting mechanism, engages at a journal end to simultaneously adjust multiple guide vanes by adjusting the adjusting element and multiple levers that are hinged thereat. Such a generic guide vane assembly with adjustable guide vanes for a compressor of a gas turbine engine is shown in U.S. Pat. No. 9,309,778 B2, for example. In practice, the bearing journals of the guide vanes, which are often also referred to as shingles, are provided in radially protruding sleeve-shaped bearing extensions of the housing. These bearing extensions are formed at a wall of the housing and ensure the rotatable mounting and support of the bearing journal.

The at least one adjusting element of the adjusting appliance provided for adjustment of the guide vanes is usually supported at an outer side of the housing and is adjustable relative to the same in the circumferential direction to cause a rotation of the guide vanes about their respective rotational axis. To keep the adjusting element at a defined radial distance to the outer side of the housing during that process, it is known to provide one or multiple compensation devices. Here, a compensation device is primarily provided for the purpose of avoiding that, during operation of the engine in which the housing is heated up stronger than the adjusting element depending on the respective cycle, the housing displaces the adjusting element radially outwards, and in this manner the adjusting precision of the adjusting element is reduced, or even a deformation or a jamming of the adjusting element occurs. A radial distance of the adjusting element to the outer side of the housing is predefined via a compensation device, and different thermal expansions of the adjusting element, on the one hand, and of the housing, on the other, are compensated to keep the adjusting element in a defined position relative to the housing, e.g. to keep a ring-shaped adjusting element centered with respect to the housing. For this purpose, for example multiple compensation devices are arranged in a manner distributed along the circumferential direction to support the adjusting element at different positions against the housing and to center it with respect to the same.

What is for example known from DE 10 2014 219 552 A1 is a compensation device with a spacer that is supported inside a compensation element in the form of a bushing. This bushing has a higher thermal expansion coefficient than the adjusting element and its spacer via which the adjusting element can be supported at an outer side of the housing. During operation of the engine, the housing of the guide vane assembly as well as the bushing that is functioning as a compensation element as well as the adjusting element are heated up. Here, the thermal expansion of the bushing leads to a radially outward displacement of the spacer attached thereat, while the thermal expansion of the adjusting element and of the spacer lead to a displacement radially inwards. What thus results due to the higher thermal expansion coefficient of the bushing is a temperature-related outward radial displacement of the spacer, which substantially corresponds to the radial elongation of the housing that occurs as a result of the temperature. The different thermal expansions of the housing and of the adjusting element are thus substantially compensated, and a radial distance between the spacer and the outer side of the housing is kept substantially constant. In this manner, a centering of the adjusting element with respect to the housing can also be maintained during operation of the engine.

However, in the guide vane assembly known from DE 10 2014 219 552 A1, the mounting of the compensation device is comparatively elaborate. In particular the spacer has to be positioned almost exactly relative to the bushing and the adjusting element to achieve the desired compensation. In addition, the bushing is inserted into a through bore of the adjusting element, so that when designing the individual components of the compensation device, it must in particular be taken into account with some effort as to what kind of heat transfer results between the adjusting element and the bushing placed herein.

SUMMARY

Thus, the invention is based on the objective to provide an improved guide vane assembly based on the state of the art described above.

This objective is achieved by means of the guide vane assembly with features as described herein.

According to the invention, the compensation device of the guide vane assembly has a compensation element that is arranged between the adjusting element and the outer side of the housing and that is connected to the adjusting element via at least one connection element of the compensation device that is hinged at the adjusting element. At that, in one embodiment variant, the compensation element that defines an abutment surface for abutment at the outer side of the housing is mounted in such a manner at the adjusting element via the connection element that, in the event of a thermal expansion of the compensation element, a radial displacement of the abutment surface with respect to the adjusting element occurs. This temperature-related occurrence of a radial displacement can compensate a temperature-related radial expansion of the housing that is stronger as compared to the adjusting element, that is, it can cause a radial distance of the compensation element to the outer side of the housing to be substantially maintained, and a defined (changed) radial distance to be present between the adjusting element and the housing even in the event that the guide vane assembly is heated up, with a predefined relative position of the adjusting element to the housing being maintained through that radial distance, for example by maintaining the centered position of the adjusting element with respect to the housing.

Thus, in the solution according to the invention, a temperature increase thus leads to a stronger expansion in the compensation element that it does in the connection element via which the compensation element is connected to the adjusting element. This may for example be achieved by the compensation element having a higher thermal expansion coefficient than the at least one connection element. In particular if the connection element and the compensation element are made of materials with (as far as possible) identical thermal expansion coefficients, or are made of the same material, it can be provided in one variant that the at least one compensation element is subject to a stronger temperature-related heating than the connection element during operation of the engine due to its dimensions and its arrangement close to the housing (as compared to the connection element). For example, the connection element is embodied to be shorter and/or slimmer than the compensation element, so that a temperature change in the environment of the housing has less of an impact on the connection element than on the compensation element with respect to a changing expansion.

The at least one connection element is also hinged at the compensation element to ensure displaceability of the compensation element relative to the adjusting element in the event of the compensation element is heated up or cooled down. The at least one connection element can be designed in a lever-like manner and be hinged at the adjusting element with the lever end. In a lever-like embodiment of the at least one connection element, one lever end of the connection element can be hinged at the adjusting element and another lever element of the connection element can be hinged at the compensation element.

For example, the compensation element is coupled in such a manner to the at least one connection element and connected via the same to the adjusting element, that, in the event of a temperature-related expansion of the compensation element along the circumferential direction, a radial distance between the compensation element and the adjusting element is changed. For example, the radial distance can decrease in the event of an expansion of the compensation element (thermal expansion), and the radial distance can increase in the event of a temperature-related contraction (thermal contraction).

In principle, the compensation element can have different geometrical designs. In one embodiment variant, it is embodied in a longitudinally extending manner, having a longitudinal extension along the circumferential direction. In this context, it can be provided that the compensation element is rod-shaped, for example.

In principle, the compensation element can be connected to the adjusting element via a single connection element that is hinged at the adjusting element, while it may for example be affixed to the adjusting element in a rigid manner in a different position, where necessary via a further component. However, in contrast to that, in one exemplary embodiment at least two connection elements are provided for connecting the compensation element to the adjusting element, being hinged at the adjusting element in positions that are arranged at a distance to each other along the circumferential direction. Correspondingly, the compensation element is mounted at the adjusting element of the adjusting appliance via at least two connection elements, so that swiveling movements of the connection element are caused by a thermal expansion of the compensation element, in turn leading to a radial displacement of the compensation element. Here, the linkage of the two connection elements and their connection to the compensation element may for example be realized in such a manner that, in the event of a thermal expansion of the compensation element, the two connection elements are pivoted about different swivel axes at the adjusting element, and namely in opposite pivoting directions (with the two swiveling axes being preferably substantially parallel).

In one embodiment variant that is based hereon, it is for example provided that the at least two connection elements are connected to the adjusting element and the compensation element in such a manner that a section of the adjusting element at which two connection elements (of the at least two connection elements) are hinged, these two connection elements as well as the compensation element extend along the edges of a virtual trapezoidal contour, as viewed along the central axis. The previously mentioned sections and elements are thus arranged in a trapezoidal manner, as seen in a view along the central axis. In that case, the compensation element extends along a base of the virtual trapezoidal contour and the two connection elements extend along two legs of the virtual trapezoidal contour, for example. The adjusting element section at which the two connection elements are hinged in turn defines the basis side of the virtual trapezoidal contour that is shorter with respect to the base and extends in parallel to the base and is connected to the base via the two legs that extend in an angled manner thereto. By linking the connection elements at the adjusting element, on the one hand, and at the compensation element, on the other, the trapezoidal contour is compressed in this configuration as a result of a thermal expansion of the compensation element that possibly abuts on an outer side of the housing, and as a result a radial distance of the compensation element to the adjusting element is reduced. This altered radial distance between the adjusting element and the compensation element substantially compensates a radial thermal expansion of the housing in the direction of the adjusting element, which also expands radially outward as a result of the temperature, but does so to a lesser degree, so that the relative position of the compensation element to the outer side of the housing remains substantially unchanged, even as the housing and the adjusting element expand to different degrees as a result of the temperature.

The virtual trapezoidal contour, along which in particular the two connection elements and the compensation element extend in one embodiment variant, can correspond to the contour of an isosceles trapezoid. Forming the legs of the trapezoidal contour, the two connection elements thus extend with identical effective lengths between two connection points at the adjusting element, on the one hand, and the compensation element, on the other, and extend with identical internal angles with respect to the compensation element.

In one embodiment variant, the compensation element is connected to the adjusting element via four connection elements that are respectively hinged at the adjusting element and arranged in pairs opposite each other at two sides of the adjusting element that are facing away from each other with respect to the central axis. For example, a first pair of connection elements is located at a first end of the compensation element, while a further, second pair of connection elements is located at an end of the compensation element that is arranged at a distance along the circumferential direction. In that case, the two connection elements of a pair of connection elements are for example arranged at the adjusting element opposite each other at two (axially frontal and rear) face sides of an adjusting element with a rectangular or circular cross section, with the face sides facing away from each other. At that, the above-described embodiment variant is independent of the cross-sectional shape of the compensation element or of the adjusting element.

In principle, the adjusting element can e.g. be embodied in a tubular or sleeve-shaped manner or as a solid shaft, and/or can have a rectangular or circular cross-section.

In principle, the adjusting element can be supported via the compensation device and in particular the compensation element of the compensation device at the outer side of the housing. However, there can of course also be certain (operational) cycles of the engine in which a smaller radial distance between the compensation element and the housing is created (in particular if the adjusting element has a higher temperature than the housing).

Alternatively or additionally, multiple compensation devices that are arranged at a distance to one another along the circumferential direction and are respectively coupled to an adjusting element can be provided. In the case of multiple compensation devices of a guide vane assembly, they may in particular serve for centering the adjusting element with respect to the housing at which the guide vanes are mounted in an adjustable manner. Thanks to the compensation devices which are arranged in a manner distributed along the circumference and at which respectively at least one connection element hinged at the adjusting element and a compensation element (e.g. with a higher thermal expansion coefficient as compared to the at least one connection element) are provided, it can be achieved in the event of temperature-related different thermal expansions of the adjusting element, on the one hand, and of the housing, on the other, that the connection element remains centered with respect to the housing. Thus, an adjustability of the guide vanes by means of the adjusting element and in particular an adjustment accuracy that can be obtained through the adjusting appliance is not aversely affected or is only affected to an insignificant degree by differently strong thermal expansions (with the temperature change being the same).

In one exemplary embodiment, at least one separate sliding element, which has a sliding surface for abutment at the outer side of the housing, is attached at the compensation element. Through the sliding surface of the sliding element, for example a friction-reduced abutment of the compensation element at the housing is provided, so that the compensation element can abut at the housing in a sliding manner by means of the sliding element. Thus, the compensation element can be displaced relative to the housing in the event of a temperature-related expansion of the compensation element and/or an adjustment of the adjusting element by overcoming a comparatively low static friction (as compared to a direct abutment of the compensation element itself at the housing).

Alternatively or additionally, it can be provided that the at least one separate sliding element is inserted with a fastening section into a bore hole of the compensation element. Such a fastening section for connecting the sliding element to the compensation element may for example have means for a form-fit and force-fit fastening inside the bore hole of the compensation element. For this purpose, radially protruding snap-in webs or snap-in lamellas may for example be provided at the fastening section of the sliding element in a further development. In this manner, the sliding element can be easily inserted with its fastening section into the bore hole of the compensation element, and by being thus inserted is automatically locked therein in a manner secured against loss.

In principle, the adjusting element can be embodied as a single-piece or multi-piece adjusting ring and/or can be embodied in a ring-segment-shaped or ring-shaped manner. As has already been mentioned above, an adjusting element for a guide vane assembly, by means of which the guide vanes can be rotated about their radial rotational axis, is usually a circumferentially extending single-piece or multi-piece adjusting element in the form of an adjusting ring that is held at the housing in a displaceable manner. In one embodiment variant of a guide vane assembly according to the invention, such an adjusting ring can be centered with respect to the housing by means of at least one compensation device or multiple compensation devices that are arranged in a manner distributed around the circumference, and can be supported by means of the same in a centered manner with respect to the housing in the event of a temperature increase.

For example, the compensation element can be made at least partially of magnesium, or the compensation element may have magnesium as its manufacturing material. Alternatively or additionally, the at least one connection element can be made at least partially of titanium, in particular a titanium alloy, or the connection element may at least partially have titanium, in particular a titanium alloy, as its manufacturing material.

With the solution according to the invention, an engine, in particular a gas turbine engine, with at least one guide vane assembly according to the invention can be provided which facilitates an improved compensation of temperature-related and different thermal expansions of an adjusting element for adjusting guide vanes, on the one hand, and a housing for mounting the guide vanes, on the other.

BRIEF DESCRIPTION OF THE DRAWINGS

The attached Figures illustrate possible embodiment variants of the solution according to the invention by way of example.

DETAILED DESCRIPTION

Figure 1A:
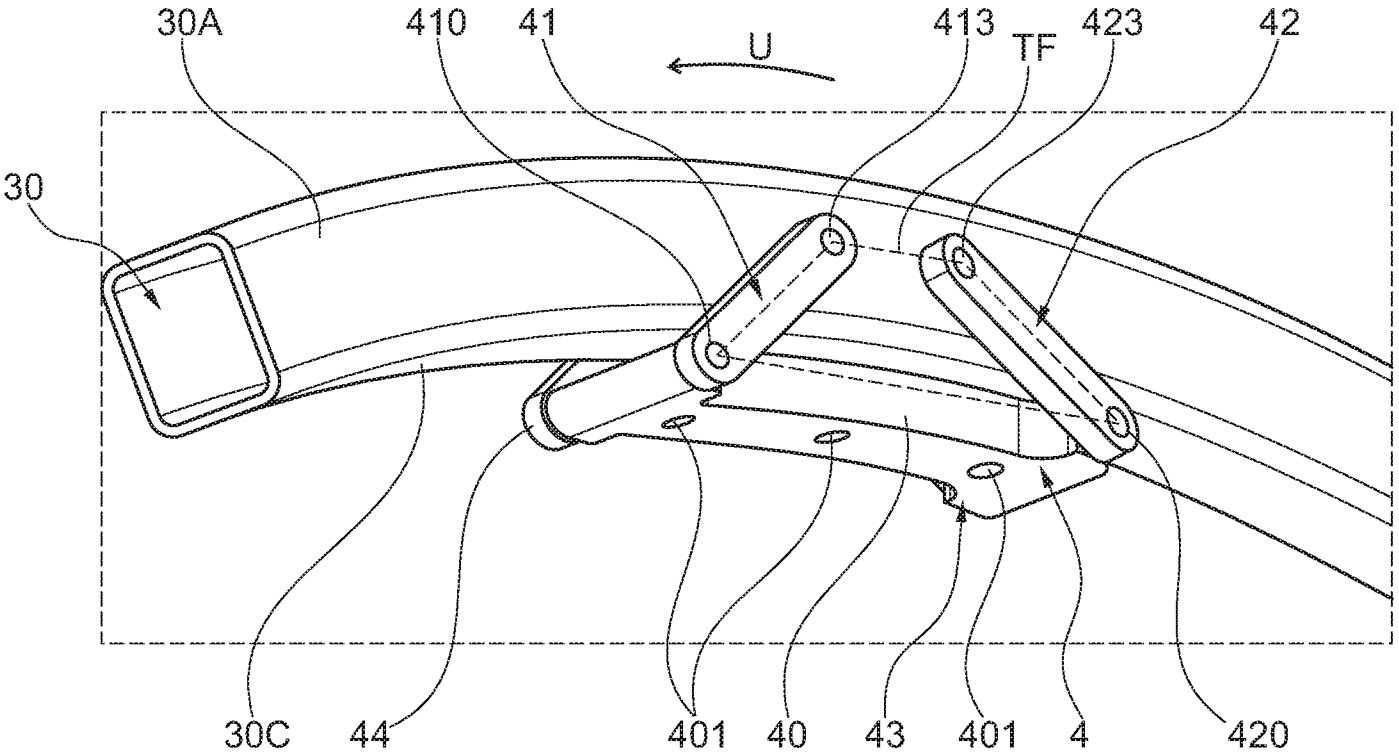
FIGS. 1A-1D show, in different views and respectively in sections, a compensation device of an embodiment variant of a guide vane assembly according to the invention with an adjusting element for adjusting the guide vanes of a guide vane row.
Figure 1B:
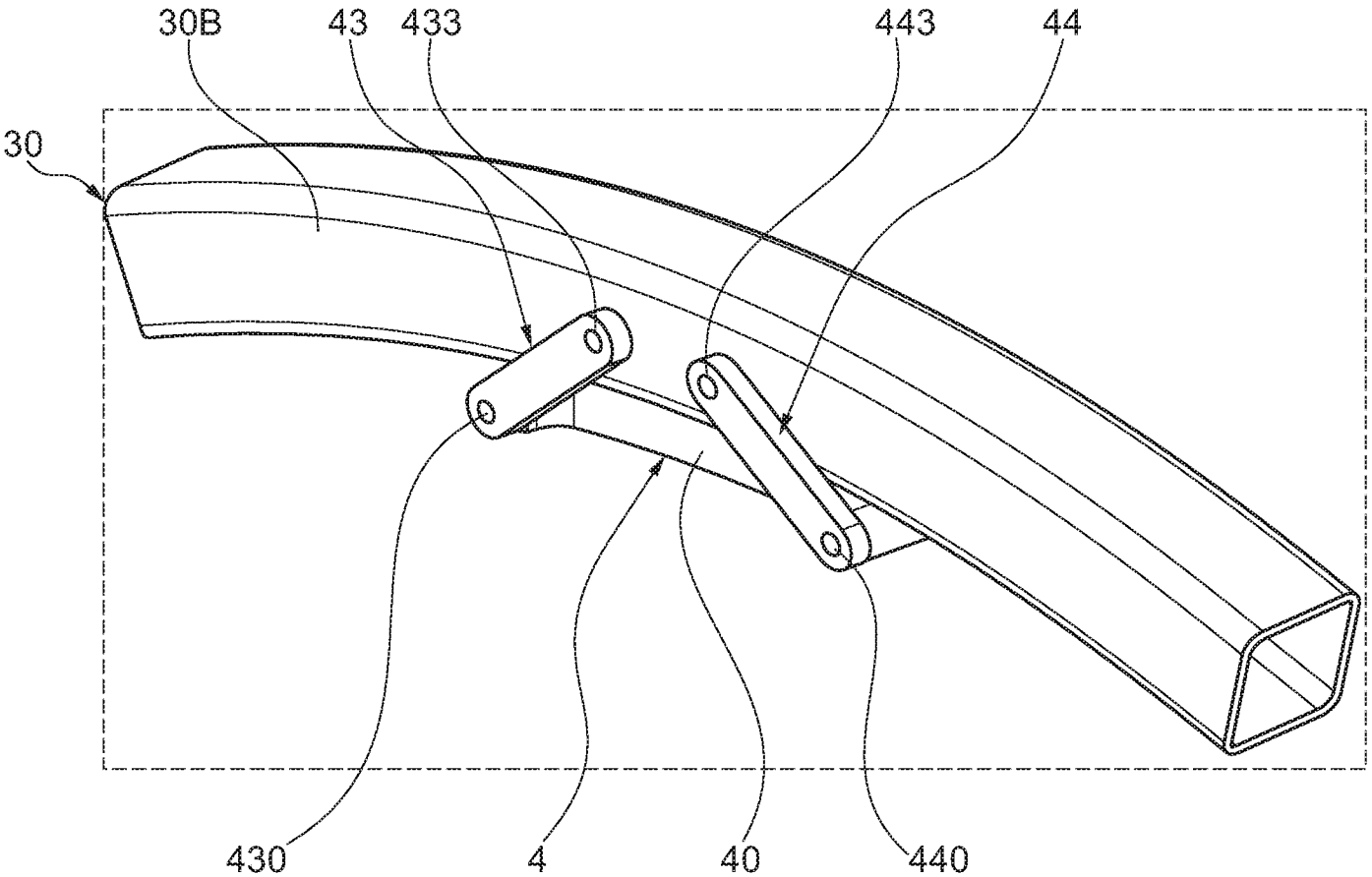
Figure 1C:
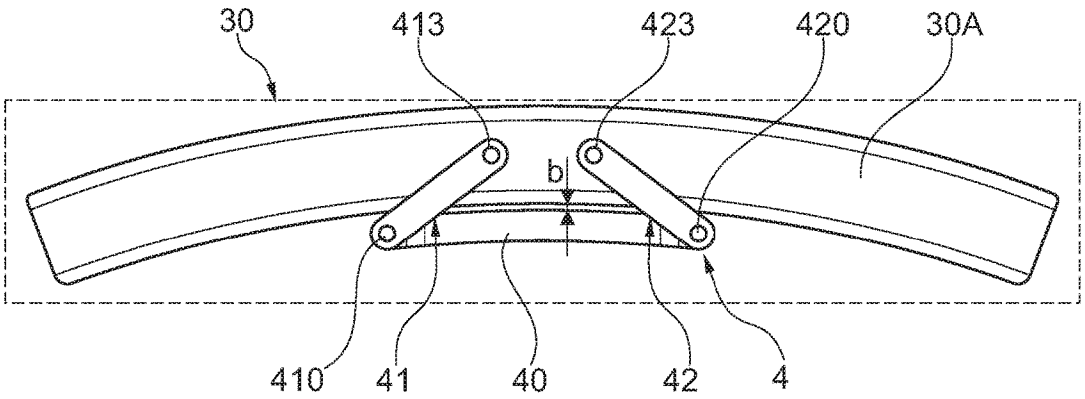
Figure 1D:
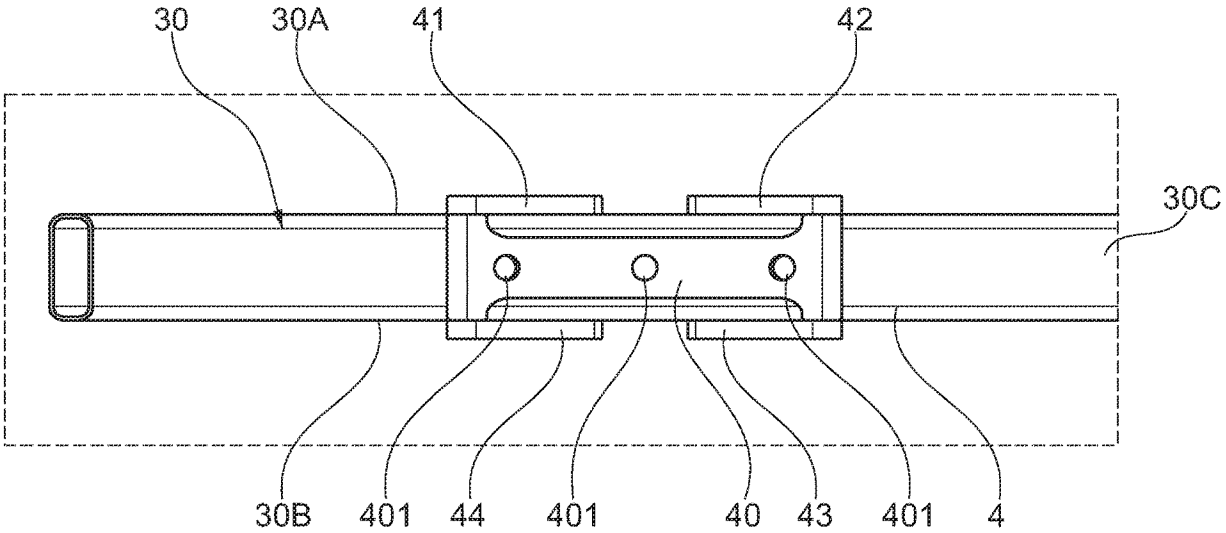
Figure 2A:
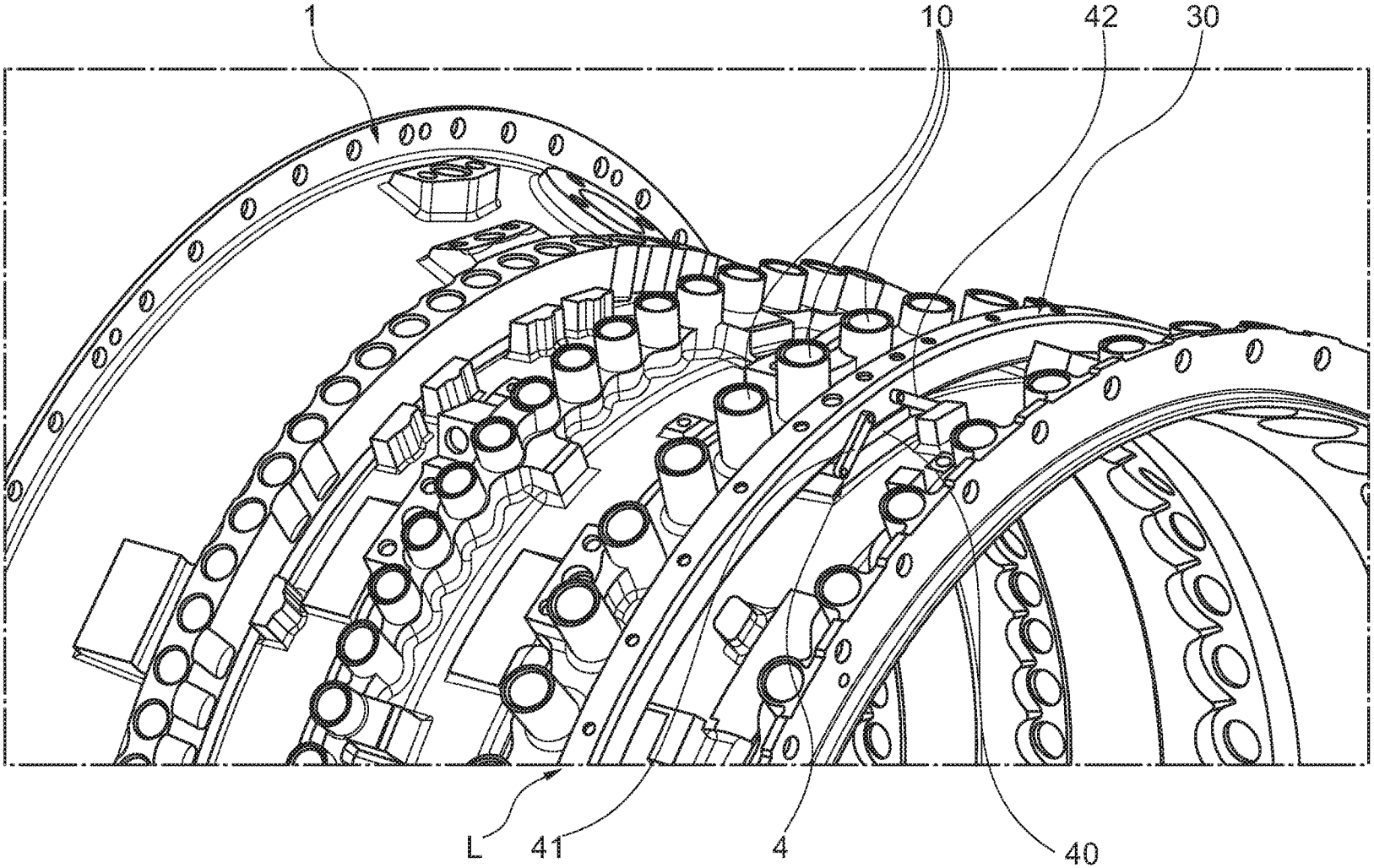
FIGS. 2A-2B show different perspective views of the embodiment variant of a guide vane assembly according to the invention, with the adjusting element and the compensation device being in a state in which they are mounted at the housing of the guide vane assembly (with the guide vanes not being illustrated).
Figure 2B:
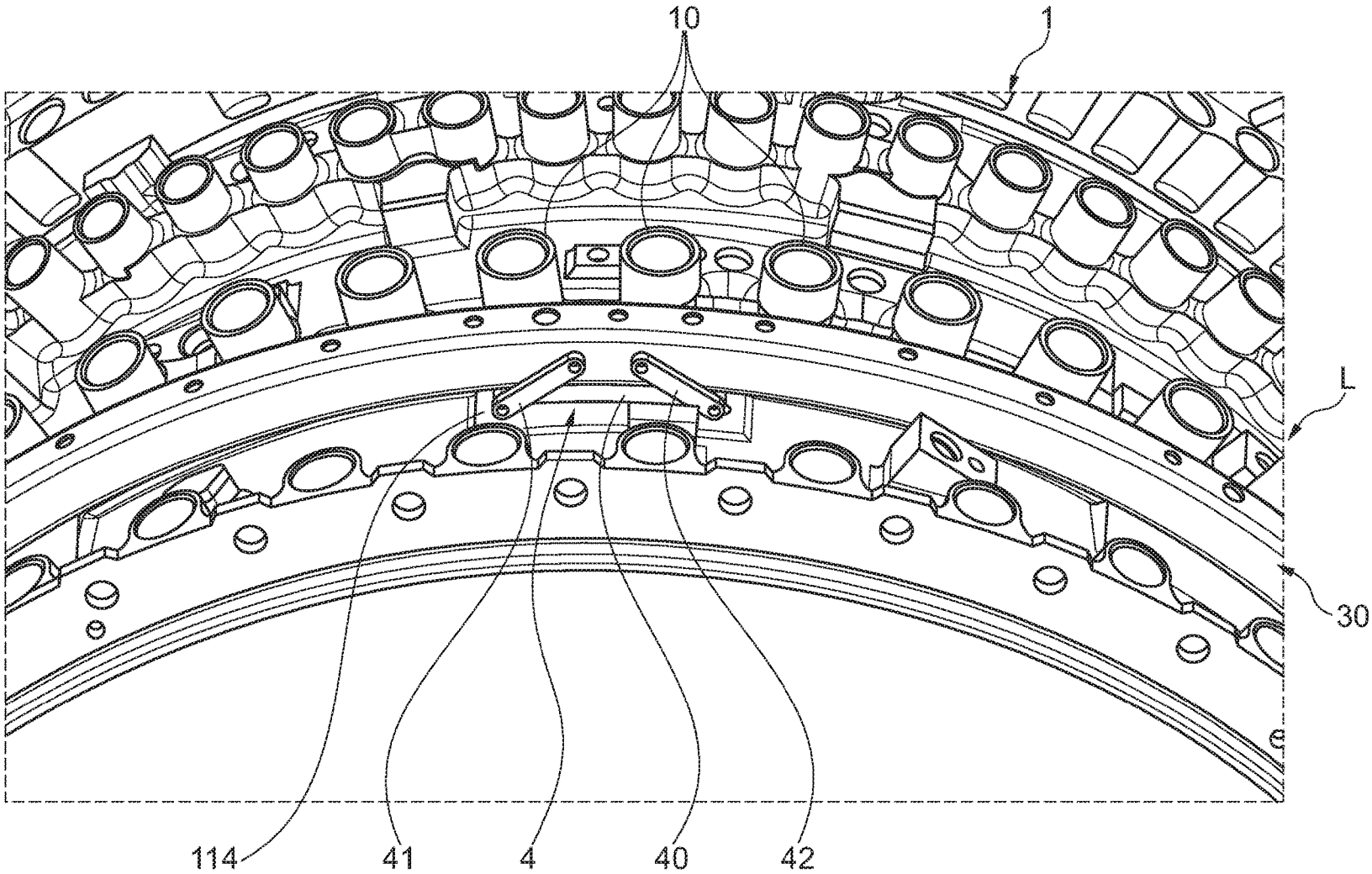
Figure 3A:
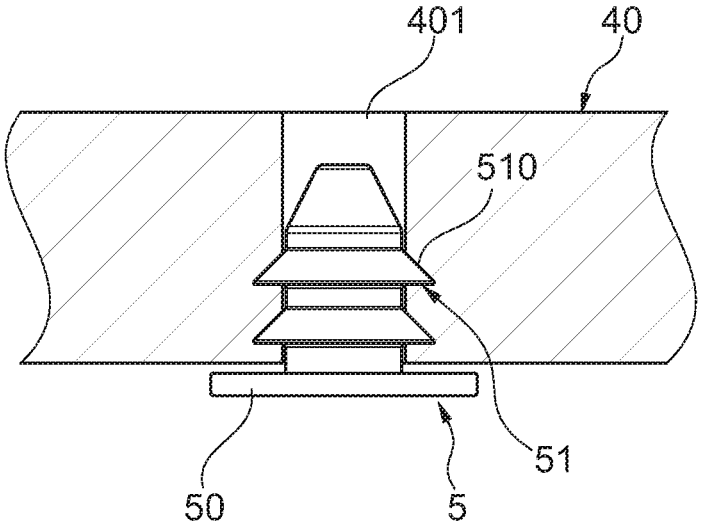
FIG. 3A shows, in sections and in an enlarged sectional view, a compensation element of the compensation device with a sliding element for abutment at an outer side of the housing being attached thereat.
Figure 3B:
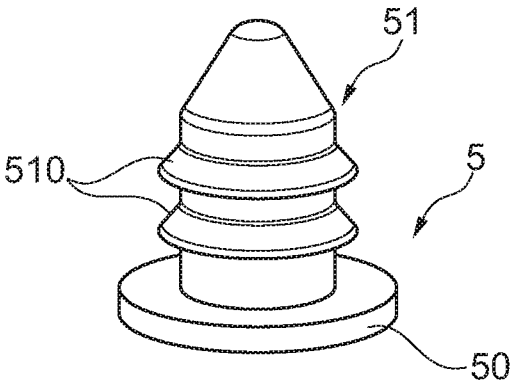
FIG. 3B shows, in a perspective view, the sliding element of FIG. 3A in a detail drawing.

FIG. 7 schematically illustrates, in a sectional rendering, a (gas) turbine engine T in which the individual engine components are arranged in succession along a central axis or rotational axis M. By means of a fan F, air is suctioned in along an entry direction E at an inlet or an intake E of the engine T. This fan F is driven via a shaft that is set into rotation by a turbine TT. Here, the turbine TT connects to a compressor V, which for example has a low-pressure compressor 11 and a high-pressure compressor 12, and where necessary also a medium-pressure compressor. The fan F supplies air to the compressor V, on the one hand, and, on the other hand, to a by-pass channel B for generating a thrust. The air that is conveyed via the compressor V is transported into the combustion chamber section BK where the driving power for driving the turbine TT is generated. For this purpose, the turbine TT has a high-pressure turbine 13, a medium-pressure turbine 14, and a low-pressure turbine 15. The turbine TT drives the fan F by means of the energy that is released during combustion in order to generate the necessary thrust by means of the air that is conveyed into the bypass channel B. The air is discharged from the bypass channel B in the area of an outlet A at the end of the engine T, where exhaust from the turbine TT flows outwards. Here, the outlet A usually has a thrust nozzle.

The compressor V comprises multiple rows of rotor blades 110 that are arranged behind each other in the radial direction, as well as rows of guide vanes 111 arranged in between them in the area of the low-pressure compressor 11. The rows of rotor blades 110 rotating about the central axis M and the rows of stationary guide vanes 111 are arranged alternatingly along the central axis M and accommodated inside a (compressor) housing 1 of the compressor V. The individual guide vanes 111 are mounted at the single-part or multi-part housing 1 in an adjustable manner—usually in addition to a radially inner bearing at the hub of the compressor V.

Figure 4:
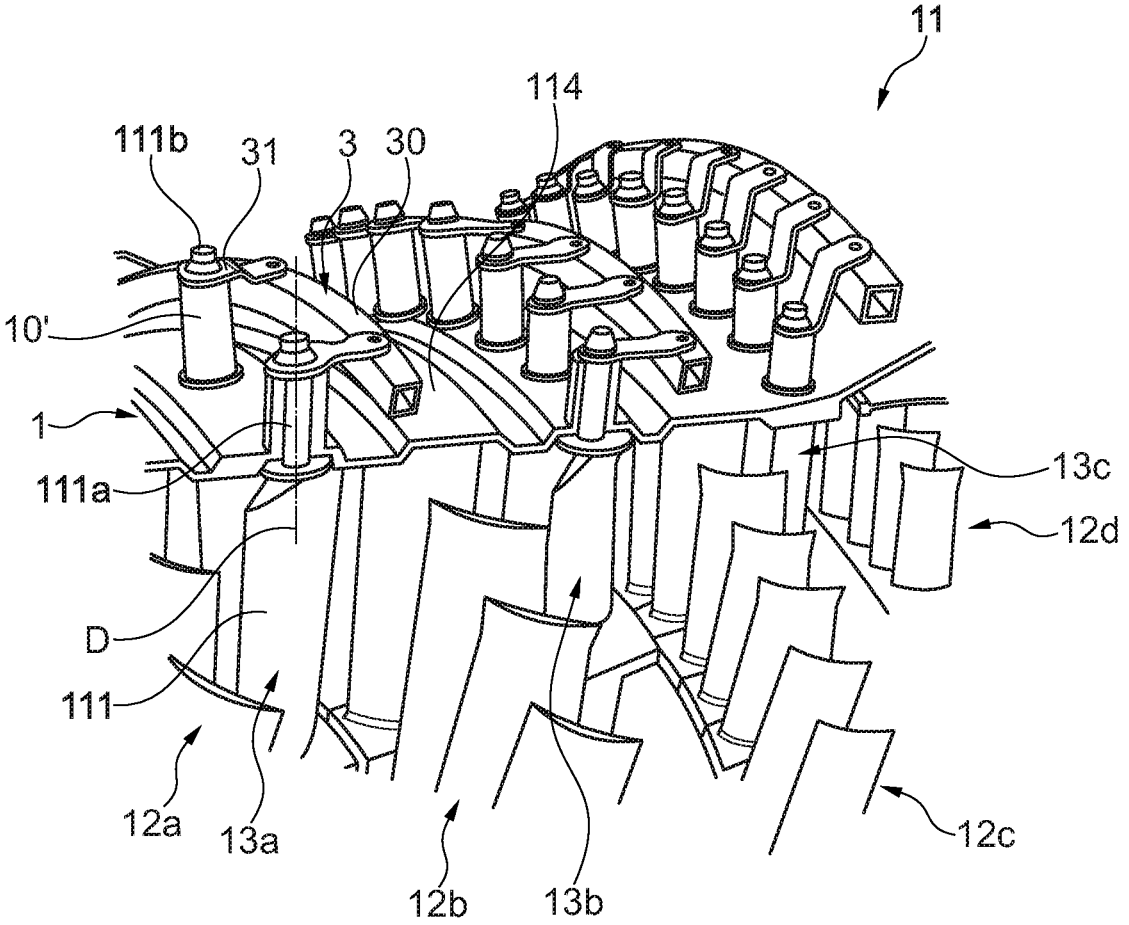
Prior art Fig. 4
FIG. 4 shows, in sections and in a perspective view, an arrangement as it is known from the state of the art with multiple guide vane assemblies with respectively one guide vane row and multiple rotor blade assemblies.
Figure 5:
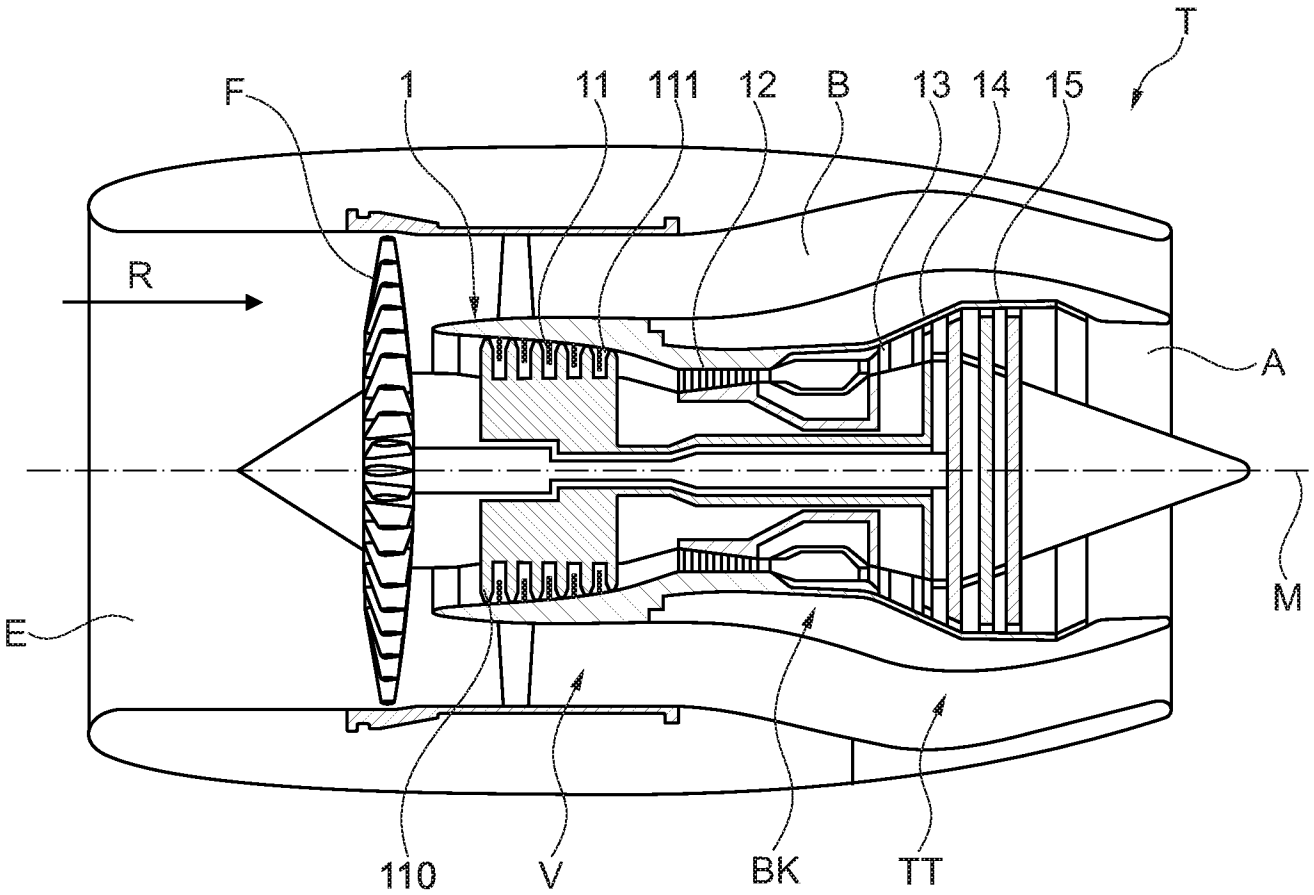
FIG. 5 shows, in sectional view and in a schematic manner, a gas turbine engine in which at least one guide vane assembly according to the invention is used.

Here, FIG. 4 shows, in sections and in greater detail, an arrangement of rotor blade rows 12*a* to 12*d* and guide vane rows 13*a* to 13*c* for the low-pressure compressor 11 as it is known from the state of the art. The guide vanes 111 of the guide vane rows 13*a*, 13*b* and 13*c* that are arranged behind each other are mounted at the housing 1 in an adjustable manner so that the position of the guide vanes 111 can be changed depending on the compressor's rotational speed. For this purpose, a bearing journal 111*a* of each rotor blade 111 is mounted in a rotatable manner in a bearing opening that is embodied by a sleeve-shaped and radially outwardly protruding bearing extension 10 of the housing 1. Each bearing journal 111*a* is mounted and supported inside an associated bearing extension 10 so as to be rotatable about a rotational axis D. At that, each bearing journal 111*a* passes through an associated bearing extension 10, so that a journal end 111*b* projects from the bearing extension 10 at the outer side of the housing 1.

Thus, respectively one adjustment lever 31 of an adjusting appliance 3 can engage at the individual journal ends 111*b* to rotate the bearing journal 111*a*, and thus change the position of the associated guide vane 111. Here, the levers 31 of a guide vane row 13*a*, 13*b* or 13*c* are respectively hinged at an adjusting element in the form of an adjusting ring 30 of the adjusting appliance 3. The adjusting ring 30, which is often comprised of multiple parts and divided into at least two segments, extends at the circumferential side along the outer shell surface of the housing 1. Thus, by adjusting the adjusting ring 30, the adjustment lever 31 hinged thereat as well as multiple, usually all, guide vanes 111 of a guide vane row 13*a*, 13*b* or 13*c* can be adjusted. At that, the individual adjusting rings 30 for the individual guide vane rows 13*a*, 13*b* and 13*c* are usually adjustable independently of each other.

An adjusting ring 30 is supported at an outer side of the housing 1, for example at a contact surface 114 that extends at the circumferential side. Here, the adjusting ring 30 is arranged at a radial distance a to the outer side of the housing 1, and in the present case to the contact surface 114, in the radial direction. This radial distance is predetermined by multiple compensation devices which are arranged in a distributed manner along the circumference and via which the adjusting ring 30 is supported at the outer side of the housing 1, and is to hold the adjusting ring 30 in a centered position with respect to the housing 1. However, during operation of the gas turbine engine T, there is the difficulty that, due to the temperature, the housing 1 expands stronger radially outwards than the adjusting ring 30, depending on the respective (operational) cycle of the engine T. Thus, inaccuracies in the adjustment of the guide vanes 111 by means of the adjusting ring 30 or even a jamming or deformation of the adjusting ring 30 may occur. The solution according to the invention aims at remedying this problem, with possible embodiment variants being illustrated in more detail based on FIGS. 1A to 1D, 2A to 2B, and 3A to 3B.

Accordingly, a compensation device 4 with a longitudinally extending, rod-shaped compensation element 40 is provided. Via the compensation device 4, different thermal expansions of the adjusting ring 30, on the one hand, and of the housing 1, on the other, are compensated by providing a compensation element 40 that is connected to the adjusting ring 30 in such a manner via multiple connection levers 41-44 (with a lower thermal expansion coefficient) hinged at the adjusting ring 30 that the compensation element 40 can be radially displaced by a temperature-related expansion (thermal expansion or contraction) relative to the adjusting ring 30. For this purpose, the compensation element 40, which in the present case is embodied in the manner of a (flat) bar, has a higher thermal expansion coefficient than the connection levers 41-44, via which the compensation element 40 is supported in a radially displaceable manner at the adjusting ring 30 between the adjusting ring 30 and the outer side of the housing 1. Further, temperature compensation is supported by the connection levers 41-44 being embodied to be shorter and slimmer than the compensation element 40, and by the compensation element 40 being arranged closer to the housing 1 (as compared to the connection levers 41-44). Thus, the temperature-related expansion has less of an impact on the connection levers 41-44 than on the compensation element 40 during operation of the engine T.

Each of the presently four connection levers 41-44 is hinged at the adjusting ring 30 at a lever end via a first hinged connection 413, 423, 433 or 443, and at its other lever end is hinged at the compensation element 40 via a second hinged connection 410, 420, 430 or 440. The connection levers 41-44 are arranged in pairs opposite each other at the two face sides 30A and 30B of the adjusting ring, and support the compensation element 40 radially with respect to a bottom side 30C of the adjusting ring 30, which is facing towards one of the outer sides of the housing 1, and is radially displaceable between the adjusting ring 30 and the outer side of the housing 1. Here, the connection of the connection levers 40-44 to the compensation element 40 is respectively realized in the area of a longitudinal end of the longitudinally extending compensation element 4. At that, the connection levers 41-44 are arranged at first and second face sides 30A and 30B of the adjusting ring 30 that are facing away from each other, with the adjusting ring 30 having a rectangular cross-section in the present case. Here, the first face side 30A forms a front face side, while the second face side 30B forms a back or rear face side of the adjusting ring 30 in the mounted state of a guide vane assembly L, which in particular comprises the adjusting ring 30 and the compensation device 4, according to the intended use.

The adjusting ring 3 can be supported against the housing 1 via the compensation element 40. For this purpose, the compensation element can abut with its bottom side at the abutment surface 114 of the housing 1, as it is illustrated in the perspective renderings of FIGS. 2A and 2B.

Viewed in an axial direction along the central axis M, the compensation element 4 extends along a virtual trapezoidal contour TF together with two connection levers 41, 42 or 43, 44 that are hinged at the first or second face side 30A or 30B, and a section of the adjusting ring 3 at which the first hinged connections 413, 423 (433, 443) are defined. Here, the compensation element 40 extends in the circumferential direction U at a longer basis side or base of this trapezoidal contour TF, while the two facing connection levers 41, 42 or 43, 44 of a face side 30A or 30B extend along two legs of this trapezoidal contour TF. The shorter basis side of the trapezoidal contour TF is formed by a section of the adjusting ring 30. Through this trapezoidal arrangement and linkage of the connection levers 41-44, it is achieved that, in the event of a temperature-related thermal expansion, the compensation element 40 is displaced relative to the bottom side 30C of the adjusting ring 30, and thus a radial distance b (cf. FIG. 10) of the compensation element 40 to the bottom side 30C of the adjusting ring 30 can change as a result of the thermal expansion of the compensation element 40.

If, for example, the compensation element 40 extends along the circumferential direction U, the facing connection levers 41, 42 and 43, 44 of a face side 30A or 30B are pivoted into opposing pivoting directions, as the lever ends connected to the compensation element 40 are put at a greater distance to each other. The virtual trapezoidal contour TF is thus compressed. The compensation element 40 is moved closer to the bottom side 30C of the adjusting ring 30. Conversely, if the compensation element 40 cools off, the connection levers 41, 42 or 43, 44 associated with a face side 30A or 30B respectively pivot towards each other with their ends that are connected to the compensation element 40. The virtual trapezoidal contour TF is elongated. The compensation element 40 is thus displaced radially inward away from the bottom side 30C of the adjusting ring 30. In this manner, the compensation device 4 compensates a temperature-related expansion of the housing 1 radially outward with respect to the adjusting ring 30 that expands radially outward to a lesser degree as a result of the temperature, and substantially maintains a radial distance of the compensation element 40 to the abutment surface 114 of the housing 1. This in particular includes a radial distance of 0 cm, and thus a direct abutment of the compensation element 40, via its abutment surface, at the housing 1, with the compensation element 40 abutting at the outer side of the housing 1 and the adjusting ring 30 being supported in this manner in the radial direction with respect to the central axis M. Through the temperature-related radial displacement of the compensation element 40 relative to the adjusting ring 3, it is ensured that the adjusting ring 3 is not locally displaced or at most only minimally displaced in certain sections by the radially outward expanding housing 1. Instead, the adjusting ring 30 is supported in a centered position with respect to the housing 1.

In order to not obstruct a temperature-related elongation or contraction of the compensation element 40 along the circumferential direction U by a possible frictionally engaged contact even during abutment at the abutment surface 114 of the housing 1, and also to be able to readily displace the compensation element 40 at the abutment surface 114 along the circumferential direction U when the guide vanes 111 are to be adjusted via the adjusting ring 30, at least one separate sliding element 5 can be attached at the compensation element 40. In the present case, a sliding element 5 is embodied in the kind of a plug and inserted into bore holes 401 of the compensation element 40 that are arranged at a distance to each other along the circumferential direction U, so that a disc-shaped head forming a sliding or contact surface 50 projects at the bottom side of the compensation element 40 from the respective bore hole 401. The compensation element 40 abuts at the abutment surface 114 of the housing 1 via this sliding or contact surface 50. Here, each sliding element 5 is inserted via a fastening section 51 into the respective bore hole 401 of the compensation element 4, and is affixed therein via snap-in lamella 510 in the respective bore hole 401, with the snap-in lamella 510 projecting radially with respect to a longitudinal axis of the journal. This is illustrated based on the enlarged rendering of FIGS. 3A and 3B. In contrast to providing at least one sliding element that can be inserted into a bore hole, a corresponding sliding/contact surface 50 at the bottom side of the compensation element 40 can of course also be formed by one sliding element that is affixed at the compensation element 40, for example by means of bonding.

By arranging the compensation device 4 at the adjusting ring 30 that is adjustable along the circumferential direction U, and thus connecting the radially displaceable compensation element 40, which abuts on the outer side of the housing 1 and against which the adjusting ring 30 is supported at the housing 1, to the adjusting ring 30, an integration of the compensation device 4 at a guide vane assembly L is possible without or with only minor constructional changes to the housing 1. The individual components of the compensation device 4 only have to be affixed at the adjusting ring. To ensure a centering of the adjusting ring 30 with respect to the housing 1 by means of multiple compensation devices 4 also during operation of the gas turbine engine T, for example at least three compensation devices 4 that are offset by 120° with respect to one another along the circumferential direction U, four compensation devices 4 that are respectively offset by 90° with respect to one another, or five compensation devices 4 that are respectively offset by 72° with respect to one another are provided at the adjusting ring 30. However, in principle any other number of compensation devices 4 that are arranged so as to be distributed along the circumferential direction U at the adjusting ring 30 can be provided.

PARTS LIST

1 housing
10 bearing extension
11 low-pressure compressor
110 rotor blade
111 guide vane
111*a* bearing journal

111*b* journal end
114 abutment surface
12 high-pressure compressor
12*a*-12*d* rotor blade row
13 high-pressure turbine
13*a*-13*c* guide vane row
14 medium-pressure turbine
15 low-pressure turbine
3 adjusting appliance
30 adjusting ring (adjusting element)
30A, 30B $1^{st}/2^{nd}$ face side
30C bottom side
31 adjustment lever
4 compensation device
40 compensation element
401 bore hole
41, 42, 43, 44 connection lever (connection element)
410, 420, 430, 440 (second) hinged connection
413, 423, 433, 443 (first) hinged connection
5 sliding element
50 sliding/contact surface
51 fastening section
510 snap-in lamellas
A outlet
A distance
B bypass channel
B distance
BK combustion chamber section
D rotational axis/spindle axis
E inlet/intake
F fan
L guide vane assembly
M central axis/rotational axis
R entry direction
T gas turbine engine
TF trapezoidal contour
TT turbine
U circumferential direction
V compressor

The invention claimed is:

1. A guide vane assembly comprising:

at least one guide vane row and a housing for the at least one guide vane row extending along a circumferential direction about a central axis, wherein the at least one guide vane row comprises multiple guide vanes that are respectively mounted at the housing in an adjustable manner by means of an adjusting appliance of the guide vane assembly, the adjusting appliance including an adjusting element for adjusting the multiple guide vanes that is arranged at a radial distance to an outer side of the housing with respect to the central axis, a compensation device by which a radial distance of the adjusting element to the outer side of the housing is predetermined, and different thermal expansions of the adjusting element, on one hand, and of the housing, on the other hand, are at least partially compensated, the compensation device including a compensation element arranged between the adjusting element and the outer side of the housing and connected to the adjusting element via at least one connection element of the compensation device that is hinged at the adjusting element, wherein the at least one connection element is also hinged at the compensation element, and wherein the compensation element has a higher thermal expansion coefficient than the at least one connection element.

2. The guide vane assembly according to claim 1, wherein the at least one connection element includes a lever hinged with a lever end at the adjusting element.

3. The guide vane assembly according to claim 1, wherein the compensation element is coupled to the at least one connection element and connected via the at least one connection element to the adjusting element such that, in an event of a temperature-related expansion of the compensation element along the circumferential direction, a radial distance between the compensation element and the adjusting element is changed.

4. The guide vane assembly according to claim 1, wherein the at least one connection element includes two connection elements hinged at the adjusting element at positions that are arranged at a distance to each other along the circumferential direction, and respectively connected to the compensation element.

5. The guide vane assembly according to claim 4, wherein the two connection elements are connected to the adjusting element and the compensation element such that at a section of the adjusting element at which the two connection elements are hinged, the two connection elements and the compensation element extend along edges of a virtual trapezoidal contour, as viewed along a central axis.

6. The guide vane assembly according to claim 5, wherein the compensation element extends along a base of the virtual trapezoidal contour and the two connection elements extend along two legs of the virtual trapezoidal contour.

7. The guide vane assembly according to claim 5, wherein the virtual trapezoidal contour corresponds to a contour of an isosceles trapezoid.

8. The guide vane assembly according to claim 4, wherein the at least one connection element includes four connection elements and the compensation element is connected to the adjusting element via the four connection elements, which are respectively hinged at the adjusting element and arranged in pairs opposite each other at two sides of the adjusting element that are facing away from each other with respect to the central axis.

9. The guide vane assembly according to claim 1, wherein the adjusting element is supported at the outer side of the housing via the compensation device.

10. The guide vane assembly according to claim 1, and further comprising a plurality of the compensation device arranged at a distance to each other along the circumferential direction and respectively coupled to the adjusting element.

11. The guide vane assembly according to claim 1, and further comprising at least one separate sliding element, which has a sliding surface for abutment at the outer side of the housing, the at least one separate sliding element being at least one chosen from attached at the compensation element and inserted with a fastening section into a bore hole of the compensation element.

12. The guide vane assembly according to claim 1, wherein the adjusting element is embodied as at least one chosen from a single-piece adjusting ring, a multi-piece adjusting ring, ring-segment-shaped and ring-shaped.

13. The guide vane assembly according to claim 1, and further comprising at least one chosen from 1) wherein the compensation element is made at least partially of magnesium and 2) the at least one connection element is made at least partially of titanium or titanium alloy.

14. An engine with at least one guide vane assembly according claim 1.

15. A guide vane assembly comprising:

at least one guide vane row and a housing for the at least one guide vane row extending along a circumferential direction about a central axis, wherein the at least one guide vane row comprises multiple guide vanes that are respectively mounted at the housing in an adjustable manner by an adjusting appliance of the guide vane assembly, the adjusting appliance including an adjusting element for adjusting the multiple guide vanes that is arranged at a radial distance to an outer side of the housing with respect to the central axis, a compensation device, by which a radial distance of the adjusting element to the outer side of the housing is predetermined, and different thermal expansions of the adjusting element, on one hand, and of the housing, on the other, are at least partially compensated, the compensation device including a compensation element arranged between the adjusting element and the outer side of the housing and connected to the adjusting element via at least one connection element of the compensation device that is hinged at the adjusting element, wherein the at least one connection element is hinged at the compensation element, wherein at least two connection elements are hinged at the adjusting element at positions that are arranged at a distance to each other along the circumferential direction, being respectively connected to the compensation element.

16. The guide vane assembly according to claim 15, wherein the at least two connection elements are connected to the adjusting element and the compensation element in such a manner that a section of the adjusting element at which two connection elements are hinged, these two connection elements and the compensation element extend along the edges of a virtual trapezoidal contour, as viewed along a central axis.

17. The guide vane assembly according to claim 16, wherein the compensation element extends along a base of the virtual trapezoidal contour and the two connection elements extend along two legs of the virtual trapezoidal contour.

18. The guide vane assembly according to claim 16, wherein the virtual trapezoidal contour corresponds to the contour of an isosceles trapezoid.

19. The guide vane assembly according to claim 15, wherein the compensation element is connected to the adjusting element via four connection elements, which are respectively hinged at the adjusting element and arranged in pairs opposite each other at two sides of the adjusting elements that are facing away from each other with respect to the central axis.

* * * * *